US007270029B1

(12) United States Patent
Papanikolaou et al.

(10) Patent No.: US 7,270,029 B1
(45) Date of Patent: Sep. 18, 2007

(54) PASSIVE ENTRY SIDE DOOR LATCH RELEASE SYSTEM

(75) Inventors: Kosta Papanikolaou, Huntington Woods, MI (US); James Joseph Loschiavo, Livonia, MI (US); Venky Krishnan, Canton, MI (US); Marcus Edward Merideth, Westland, MI (US); Bhupandra Patel, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/460,279

(22) Filed: Jul. 27, 2006

(51) Int. Cl.
*G05G 5/06* (2006.01)
*E05C 3/06* (2006.01)

(52) U.S. Cl. ..... 74/530; 292/201; 74/422; 185/37

(58) Field of Classification Search ..... 292/201, 292/216, 279, 280, DIG. 23, 22, 39, 51, 112, 292/160, 172, 142, 199; 74/502, 530, 533, 74/422, 425; 49/280; 242/388.2, 396.4; 192/223.1; 185/37
See application file for complete search history.

(56) References Cited

U.S. PATENT DOCUMENTS

| | | | | |
|---|---|---|---|---|
| 2,739,485 | A * | 3/1956 | Sengebusch | 74/111 |
| 3,010,750 | A * | 11/1961 | Cockburn | 292/279 |
| 3,699,608 | A * | 10/1972 | Schwarz | 16/79 |
| 3,843,175 | A * | 10/1974 | Klebba | 292/216 |
| 4,702,117 | A * | 10/1987 | Tsutsumi et al. | 74/89.17 |
| 4,927,196 | A * | 5/1990 | Girard et al. | 292/201 |
| 5,697,236 | A | 12/1997 | Kleefeldt et al. | |
| 5,791,179 | A * | 8/1998 | Brask | 70/278.1 |
| 6,264,257 | B1 | 7/2001 | Meinke | |
| 6,367,296 | B1 | 4/2002 | Dupont | |
| 6,401,792 | B1 * | 6/2002 | Mullet et al. | 160/188 |
| 6,474,704 | B1 | 11/2002 | Rathmann | |
| 6,719,333 | B2 * | 4/2004 | Rice et al. | 292/216 |
| 7,163,239 | B2 * | 1/2007 | Fisher | 292/216 |
| 2004/0195845 | A1 | 10/2004 | Chevalier | |
| 2005/0104382 | A1 * | 5/2005 | Schupp | 292/201 |
| 2005/0134053 | A1 | 6/2005 | Spurr et al. | |
| 2005/0205361 | A1 * | 9/2005 | Fisher | 185/37 |
| 2005/0212302 | A1 | 9/2005 | Fisher | |

FOREIGN PATENT DOCUMENTS

DE 4306772 A1 * 9/1994

* cited by examiner

*Primary Examiner*—Brian Glessner
*Assistant Examiner*—Alyson M. Merlino
(74) *Attorney, Agent, or Firm*—Dykema Gossett PLLC

(57) ABSTRACT

A vehicle passive entry side door latch release system engageable with a release cable connected a door latch includes a moveable linkage assembly engageable with the cable, and a motor including an output shaft engaged with a tensioning gear for driving a ratcheting gearwheel rotatably affixed to a coil spring, with the gearwheel including external teeth engageable with a rack affixed to the linkage to move the cable to unlatch the door latch. A pivotable ratcheting pawl may be engageable with the gearwheel to allow or prevent rotation of the gearwheel. Operation of the motor may drive the gear to drive the gearwheel in a rotary direction to energize the spring, and disengagement of the pawl from the gearwheel may allow stored energy in the spring to drive the gearwheel in an opposite rotary direction to thereby drive the rack to move the cable to unlatch the door latch.

13 Claims, 5 Drawing Sheets

PASSIVE ENTRY SIDE DOOR LATCH RELEASE SYSTEM

BACKGROUND OF INVENTION a. Field of Invention

The invention relates generally to vehicle door latch release systems, and, more particularly, to a vehicle passive entry side door latch release system that can operate with existing door latch assemblies.

b. Description of Related Art

In recent years, automatic vehicle door latch release systems have become increasingly popular and are now available in a variety of new vehicles. Such door latch release systems normally operate by sending an electrical signal to a latch release unit when an operator either pulls an outside door handle, depresses an actuation switch underneath or adjacent the handle, or otherwise approaches the vehicle with a remote access unit. Once the outside handle is pulled or otherwise actuated, the latch release unit must release the latch or otherwise unlock the door within 50 ms or less to enable seamless operation of the latch release (or unlocking) and door opening functions.

More specifically, the operation of a typical passive latch release system is initiated when a user carrying a remote transmitter (i.e. a key fob) approaches a vehicle. The latch release system is thus activated upon the user's approach and verifies an encoded signal sent by the remote transmitter to activate the system. The latch release system then authenticates the encoded signal and performs a series of functions for allowing the user to open the door.

Such an exemplary passive latch release system is disclosed for example in U.S. patent application No. 2004/0195845 to Chevalier. Referring to FIGS. 1-3 of Chevalier, the latch arrangement (100) includes an electric motor (34) controlled by an electronic control unit (7) and further includes a plurality of actuators (700, 800) arranged to release, lock and/or unlock the latch to a vehicle door. The electronic control unit (7), which controls motor (34) to release, lock and/or unlock the latch, is responsive to movement of an external manual actuator for allowing the door to be opened. Another exemplary passive latch or lock release system is disclosed in U.S. Pat. No. 6,474,704 to Rathmann. Referring to FIG. 1 of Rathmann, the latch release system includes two actuating motors (10, 13) to drive multiple step down gears (15, 16, 8) to rotatably displace a latch pawl (4).

Latch release systems, such as the systems disclosed by Chevalier and Rathmann, as well as other U.S. Patents and Publications such as U.S. Pat. No. 6,367,296 to Dupont and U.S. Publication No. 2005/0134953 to Spurr, thus require a relatively complex latch release assembly for actuating a door latch via the outside door handle or otherwise via a remote unit. However, for existing conventional latch release systems which generally include an outside door handle and latch rod assembly for operating a door latch from the outside of a vehicle, and an inside door handle and release cable assembly for operating the door latch from the inside of a vehicle, the noted Chevalier passive latch release system is inoperable without removal and replacement of the existing latch release assembly. While such removal and replacement of the existing latch release assembly may be performed on a limited basis, it would be beneficial to have a door latch release system which is operable with existing latch release assemblies while minimizing the time and expense of modifying or otherwise replacing an existing assembly for automatic latch release operation. While the Rathmann passive latch release system decreases current demand for operation, this is at the expense of operation speed and component complexity. Other systems, while able to operate a door latch within 50 ms, require motors with high space and current demands that are difficult to meet in vehicle applications.

Accordingly, there remains a need for a door latch release assembly, which is economical to manufacture, install and service, in vehicles with existing conventional latch release assembly designs, as well as in vehicles where the latch release or door unlock assembly is operable by pulling one or more release cables. There also remains a need for a door latch release assembly which is robust in design for long term use in a variety of vehicles, which reduces design and tooling costs, and which further meets automotive fit and operation requirements for such components. Additionally, there remains a need for a latch assembly that consumes a low amount of current yet can actuate a latch in a short period of time, while minimizing overall component package space.

SUMMARY OF INVENTION

The invention solves the problems and overcomes the drawbacks and deficiencies of prior art passive door latch release systems by providing a vehicle passive entry side door latch release system engageable with a release cable connected to a door latch. The door latch release system may include a moveable linkage assembly engageable with the release cable, and a motor including an output shaft selectably engageable with a tensioning gear selectably engageable to drive a ratcheting gearwheel rotatably affixed to a coil spring, with the ratcheting gearwheel including external teeth engageable with a rack affixed to or formed with the linkage assembly to move the release cable to unlatch the door latch. One or more pivotable ratcheting pawls may be selectably engageable with the ratcheting gearwheel to allow or prevent rotation of the ratcheting gearwheel. Operation of the motor in a first motor rotary direction may selectably drive the tensioning gear to drive the ratcheting gearwheel in a first gear rotary direction to energize the coil spring, and operation of the motor in a second opposite motor rotary direction may selectably disengage the ratcheting pawl to allow stored energy in the coil spring to drive the ratcheting gearwheel in a second opposite gear rotary direction to thereby drive the rack to move the release cable to unlatch the door latch.

For the door latch release system described above, the linkage assembly may include one or more apertures for insertion of one or more cables, and further include a lever contiguously engaged with a leaf spring and attachable at one end thereof to a first cable attachable to the rack, attachable at a second opposite end thereof to a second cable attachable to an inside door handle, and attachable at an intermediate location thereof to the release cable. The linkage assembly may be spring biased towards the release cable to maintain the door latch in a latched configuration. The linkage assembly may alternatively include a lever attachable at a first location thereof to a first cable attachable to the rack, attachable at a second location thereof to a second cable attachable to an inside door handle, and attachable at a third location thereof to the release cable. The motor output shaft may be selectably engageable with the tensioning gear or with the ratcheting pawl respectively by a first clutch plate engageable with a second clutch plate to drive the tensioning gear, and with the first clutch plate engageable with a third clutch plate to disengage the ratcheting pawl from the ratcheting gearwheel. The door latch release system may further include an electronic control unit for controlling the motor.

The invention also provides a vehicle passive entry side door latch release system engageable with a release cable connected a door latch. The door latch release system may include a moveable linkage assembly engageable with the release cable, and a motor including an output shaft engaged with a tensioning gear for driving a ratcheting gearwheel rotatably affixed to a coil spring, with the ratcheting gearwheel including external teeth engageable with a rack affixed to or formed with the linkage assembly to move the release cable to unlatch the door latch. One or more pivotable ratcheting pawls may be selectably engageable with the ratcheting gearwheel to allow or prevent rotation of the ratcheting gearwheel. Operation of the motor may drive the tensioning gear to drive the ratcheting gearwheel in a first gear rotary direction to energize the coil spring, and disengagement of the ratcheting pawl from the ratcheting gearwheel may allow stored energy in the coil spring to drive the ratcheting gearwheel in a second opposite gear rotary direction to thereby drive the rack to move the release cable to unlatch the door latch.

For the door latch release system described above, the linkage assembly may include one or more apertures for insertion of one or more cables, and further include a lever contiguously engaged with a leaf spring and attachable at one end thereof to a first cable attachable to the rack, attachable at a second opposite end thereof to a second cable attachable to an inside door handle, and attachable at an intermediate location thereof to the release cable. The linkage assembly may be spring biased towards the release cable to maintain the door latch in a latched configuration. The linkage assembly may alternatively include a lever attachable at a first location thereof to a first cable attachable to the rack, attachable at a second location thereof to a second cable attachable to an inside door handle, and attachable at a third location thereof to the release cable. The motor output shaft may be engageable with the tensioning gear or with the ratcheting pawl respectively by a first clutch plate engageable with a second clutch plate to drive the tensioning gear, and with the first clutch plate engageable with a third clutch plate to disengage the ratcheting pawl from the ratcheting gearwheel. The ratcheting pawl may be disengageable from the ratcheting gearwheel by an actuator, a further motor and/or a solenoid.

The invention further provides a vehicle passive entry side door latch release system engageable with a release cable connected a door latch. The door latch release system may include a movable linkage assembly engageable with the release cable, and a motor including an output shaft having a first gear engaged with a second gear affixed to or formed with a third gear engaged with one or more ratcheting pawls engaged with internal gear teeth of a ring gear rotatably affixed to a coil spring, with the ring gear including external teeth engageable with a rack affixed to or formed with the linkage assembly to move the release cable to unlatch the door latch. Operation of the motor in a first motor rotary direction may drive the first, second and third gears in a first gear rotary direction to rotatably compressibly engage the pawl against the internal gear teeth of the ring gear to rotate the ring gear in the first gear rotary direction to energize the coil spring, and operation of the motor in a second opposite motor rotary direction may drive the first, second and third gears in a second opposite gear rotary direction to rotatably disengage the pawl from the internal gear teeth of the ring gear to allow stored energy in the coil spring to drive the ratcheting gearwheel in the second opposite gear rotary direction and to thereby drive the rack to move the release cable to unlatch the door latch.

For the door latch release system described above, the system may include an electronic control unit for controlling the motor, and a freewheeling plate having one or more pins for the rotatable attachment of the pawl. The linkage assembly may include one or more apertures for insertion of one or more cables, and may further include a lever contiguously engaged with a leaf spring and attachable at one end thereof to a first cable attachable to the rack, attachable at a second opposite end thereof to a second cable attachable to an inside door handle, and attachable at an intermediate location thereof to the release cable. The linkage assembly may be spring biased towards the release cable to maintain the door latch in a latched configuration. The linkage assembly may alternatively include a lever attachable at a first location thereof to a first cable attachable to the rack, attachable at a second location thereof to a second cable attachable to an inside door handle, and attachable at a third location thereof to the release cable.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
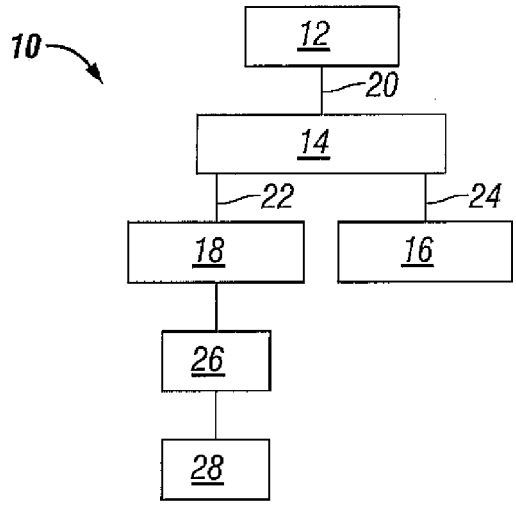
FIG. 1 is a block diagram illustrative of the location of a door latch release system according to the present invention relative to a vehicle inside door handle, a movable linkage, and its corresponding door latch.
Figure 2:
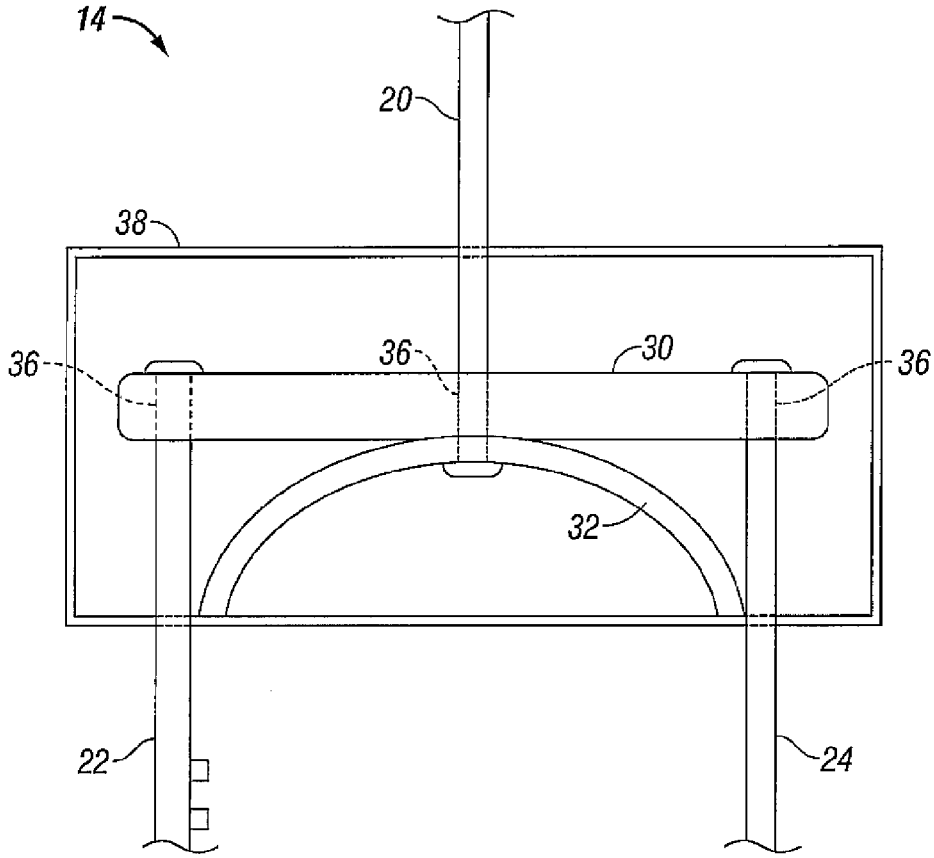
FIG. 2 is a view illustrative of an embodiment of the movable linkage of FIG. 1, illustrating the linkage in a rest configuration.
Figure 3:
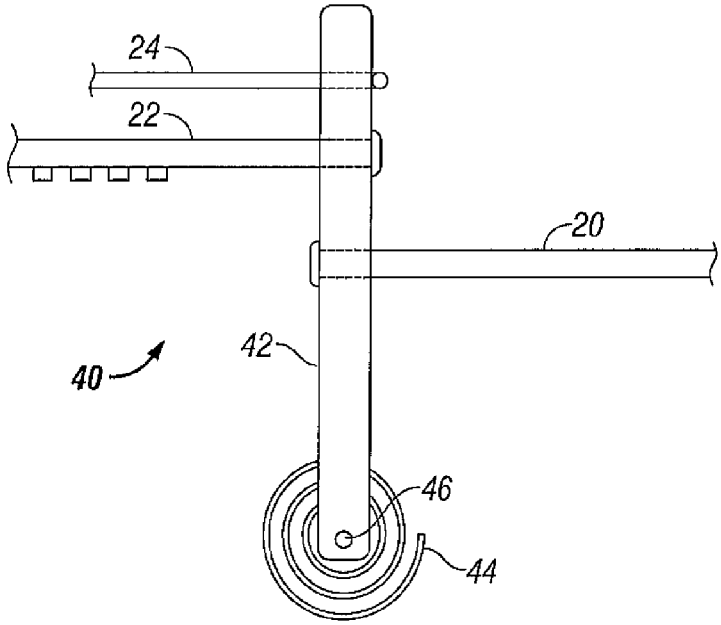
FIG. 3 is a view illustrative of another embodiment of the movable linkage of FIG. 1, illustrating the linkage in a rest configuration.

Referring now to the drawings wherein like reference numerals designate corresponding parts throughout the several views, FIG. 1 is a block diagram illustrative of a vehicle door latch release system according to the present invention, FIGS. 2 and 3 illustrate various embodiments of a movable linkage usable with the door latch release system of FIG. 1, and FIGS. 3-8 illustrate various embodiments of a cable release mechanism for use in the above-mentioned door latch release system.

As is known in the art, a conventional vehicle door latch release system generally includes an inside door handle connected to a door release latch by means of a release cable, and further includes an outside door handle connected to the door release latch by means of a latch rod. As is also known in the art, in order to open a conventional vehicle door from the outside, the door must first be unlocked and thereafter opened by, for example, the outside door handle. Further, in order to open a conventional vehicle door from the inside, for vehicles with a lock over-ride feature, the inside door handle may be used to open the door with or without the lock engaged. For vehicles which do not have such a lock over-ride feature for the inside door (i.e. for a rear door), the door must first be unlocked and thereafter opened by the inside door handle. The present invention may therefore be used with vehicles including a lock over-ride feature for the interior door handle, for vehicles for which a latch release cable may be pulled to unlock a door, for vehicles for which a latch release cable may be pulled for opening a latch or other functions, and with other latch systems as would be evident to those skilled in the art.

Referring to FIG. 1, the present invention generally provides door latch release system 10 including a door latch 12, a movable linkage 14 attached to an inner door handle 16 and a release mechanism 18. In the embodiment illustrated, movable linkage 14 may be disposed at an intermediate location between door latch 12 on one side and door handle 16 and release mechanism 18 on the other side. As briefly discussed above, latch 12 may be disengaged by applying tension to a latch release cable or rod 20 disposed between latch 12 and movable linkage 18. In a similar manner as door handle 16, movable linkage 14 may likewise apply tension to latch release cable 20 upon the application of tension to linkage 22 thereof or upon the application of tension to inner door handle linkage 24. Movable linkage 14 may therefore serve to tension latch release cable 20 upon the application of tension to either of the other two linkages 22 or 24.

In a particular embodiment of door latch release system 10, door latch release mechanism 18 may be controlled by an electronic control unit 26 which actuates system 10 upon receiving a signal from a source 28, such as upon movement of an outside door handle (not shown), actuation of a switch (not shown) adjacent the outside door handle, a remote actuation unit (not shown), or by means of another source or method for providing an actuation signal.

Referring next to FIGS. 2 and 3, two exemplary embodiments of movable linkage 14 according to the present invention are illustrated.

Referring to FIG. 2, movable linkage assembly 14 may be formed as an elongated structure having a lever 30 and leaf-spring 32. As readily evident to those skilled in the art in view of this disclosure, a variety of other structures which allow for tensioning of latch release cable 20 upon the application of tension to either of the other two linkages 22 or 24 may be used for movable linkage assembly 14 without departing from the scope of the present invention. In the embodiment illustrated, lever 30 may include apertures 36 for insertion of linkages 20, 22 and 24 connectable to latch 12, release mechanism 18 and inner handle 16 at their respective opposite ends. The application of tension to linkages 22 or 24 will, therefore, result in the application of tension to cable release linkage 20, and thus release of latch 12. As readily evident to those skilled in the art, a variety of structures may be used for linkages 20, 22 and 24 including rods, racks, cables, bowden cables, screws and other means for transferring tension. For example, a means (not shown) of applying tension to linkages 20, 22 and 24 may alternately be connected directly to or formed with lever 30. Yet further, a housing 38 may be included for providing stability to movable linkage assembly 14.

Referring next to FIG. 3, an alternate embodiment of the afore-described movable linkage assembly 14, now designated assembly 40, may be formed as an elongated structure having a lever 42 and a coil spring 44. As discussed above for movable linkage assembly 14, a variety of other structures which allow for tensioning of latch release cable 20 upon the application of tension to either of the other two linkages 22 or 24 may be used for movable linkage assembly 40 without departing from the scope of the present invention. In the embodiment illustrated, lever arm 42 may include apertures (similar to apertures 36 of FIG. 2) for insertion of linkages 20, 22 and 24 connectable to latch 12, release mechanism 18 and inner handle 16 at their respective opposite ends. Lever arm 42 may also be rotatable about a pivot 46, and be biased by coil spring 44 to rotatably return to the rest configuration illustrated in FIG. 3 upon the release of tension from linkages 20, 22 and 24. The application of tension to linkages 22 or 24 will therefore result in the application of tension to linkage 20, and thus release of latch 12. As with movable linkage assembly 14, a variety of structures may be used for linkages 20, 22 and 24 including rods, racks, cables, bowden cables, screws and other means for transferring tension. Moreover, as with movable linkage assembly 14, a means (not shown) of applying tension to linkages 20, 22 and 24 may alternately be connected directly to or formed with lever 42.

Referring next to FIGS. 4-8, various embodiments of release mechanism 18 according to the present invention are illustrated.

Figure 4:
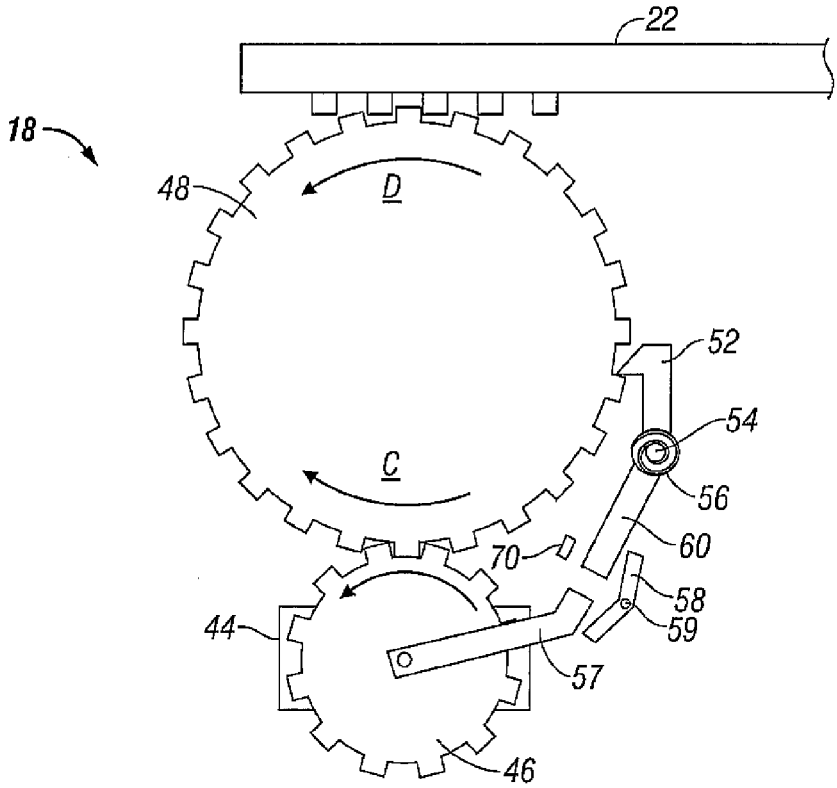
FIG. 4 is an illustrative side view of an embodiment of the door latch release system of FIG. 1, illustrating the system in a rest configuration, with components such as the clutch plates illustrated in FIG. 5 omitted for clarity.
Figure 5:
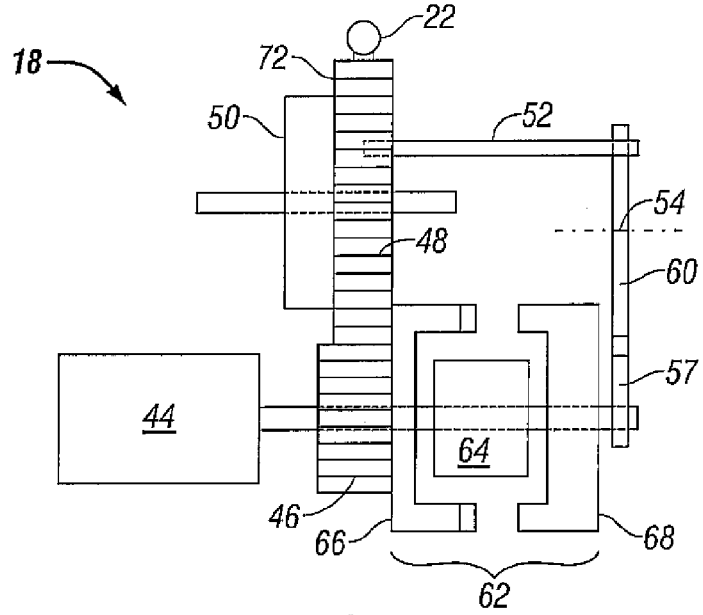
FIG. 5 is an illustrative top view of the door latch release system of FIG. 4, illustrating the system in a rest configuration.

Referring to FIGS. 4 and 5, in one embodiment, release mechanism 18 may include a motor 44 having an output shaft affixed to or otherwise formed with tensioning gear 46 which engages a ratcheting gearwheel 48 (note clutch 62 described below and illustrated in FIG. 5 is omitted from FIG. 4 for clarity). Ratcheting gearwheel 48 may be affixed to a coil spring 50 for windably storing energy therein as ratcheting gearwheel 48 is rotated in charge direction C by tensioning gear 46, for example, in a clockwise direction in the orientation of FIG. 4. Once fully rotated in the clockwise direction, release mechanism 18 may thus be placed in a charged configuration. Release of the stored energy in coil spring 50 for discharging of release mechanism 18 may be restrained by a ratcheting pawl 52 which is pivotable about axis 54 in a clockwise direction (as illustrated) for release of ratcheting gearwheel 48 and spring biased in a counter-clockwise direction by coil spring 56 for engagement with ratcheting gearwheel 48. Ratcheting pawl 52 may likewise be rotated in a clockwise direction for allowing rotation of ratcheting gearwheel 48 for charging thereof. A lever 57 may be provided for disengaging ratcheting pawl 52 from ratcheting gearwheel 48 upon pivotal movement thereof in a clockwise direction for engagement with an intermediate lever 58, which is pivoted at pivot point 59 in a counter-clockwise direction, and which further engages pawl lever 60 extending from ratcheting pawl 52. Lever 57 may be rotated in the clockwise direction for engagement with pawl lever 60 by motor 44, and/or may be otherwise biased by a spring at least in the clockwise disengagement direction. As shown in FIG. 5, motor 44 may be operable to drive tensioning gear 46 or lever 57 by a clutch 62 which includes a first clutch plate 64 engageable with second and third clutch plates 66, 68. Second clutch plate 66 may be affixed to or otherwise formed with tensioning gear 46 so that when clutch plate 64 engages clutch plate 66, tensioning gear 46, which is otherwise a free-wheeling gear, is driven by the motor. Further, third clutch plate 68 may be rotatably connected to, affixed to or otherwise formed with lever 57 so that when clutch plate 64 engages clutch plate 68, lever 57 is rotated as needed. A stop 70 may be provided for limiting rotation of pawl lever 60.

In operation, in order to actuate release mechanism 18 from its charged to its discharged configurations, upon receiving a signal from source 28, electronic control unit 26 may actuate system 10 and thus actuate release mechanism 18 to operate motor 44 to drive lever 57 (via engagement of clutch plates 64, 68) to disengage pawl 52 (via engagement of lever 57, lever 58 and pawl lever 60) from ratcheting gearwheel 48. Upon disengagement of pawl 52, coil spring 50 (which has been wound) may cause ratcheting gearwheel 48 to rotate in a counter-clockwise discharge direction D in the orientation of FIG. 4. Ratcheting gearwheel 48, which in the embodiment illustrated, may be in the form of a pinion 72, may thus drive rack 22 to the left in the perspective of FIG. 4 to thus place movable linkage 14 in tension for release of latch 12. As discussed above, freewheeling tensioning gear 46 may simply rotate during the discharging process. After release of latch 12, release mechanism 18 may again be placed in a charged configuration in which motor 44 may be operated to drive tensioning gear 46 (via engagement of clutch plates 64, 66) to rotate ratcheting gearwheel 48 in a clockwise charge direction C to therewith wind and charge coil spring 50. As discussed above, once fully wound: ratcheting gearwheel 48 may be held in place by pawl 52. The afore-described charging/discharging processes may be repeated as needed upon receiving further signals from source 28.

Figure 6:
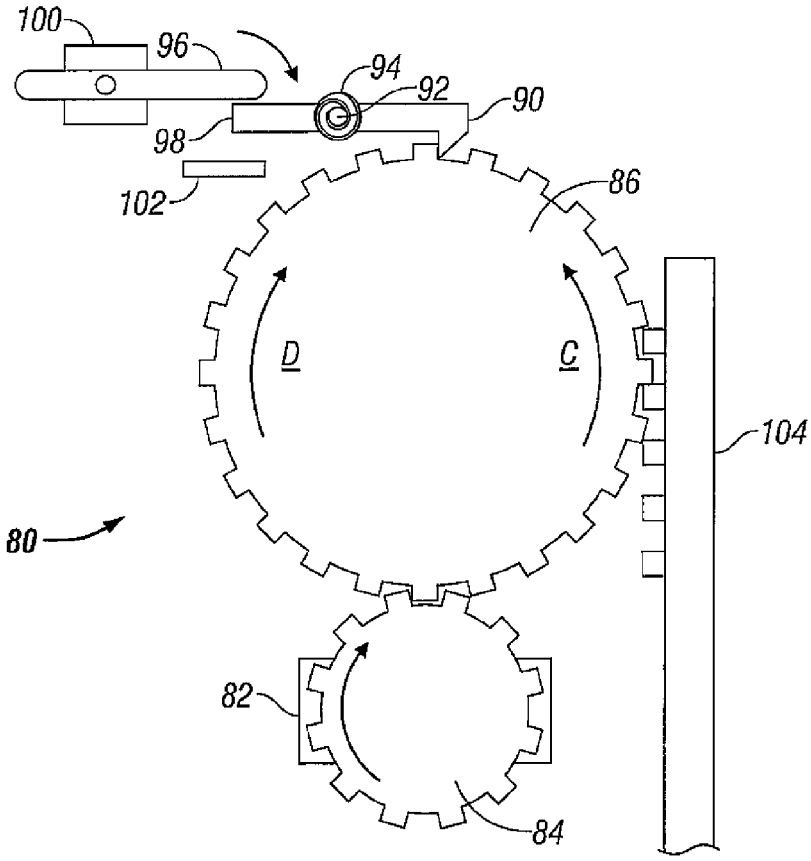
FIG. 6 is an illustrative side view of another embodiment of the door latch release system of FIG. 1, illustrating the system in a rest configuration.

Referring next to FIG. 6, an alternate embodiment of the afore-described release mechanism, now designated release mechanism 80, may include a motor 82 having an output shaft affixed to or otherwise formed with a tensioning gear 84 engageable with a ratcheting gearwheel 86. In a similar manner as release mechanism 18, ratcheting gearwheel 86 may be affixed to a coil spring (not shown, but disposed behind ratcheting gearwheel 86 in a similar manner as coil spring 50) for windably storing energy therein as ratcheting gearwheel 86 is rotated by motor 82, for example, in a counter-clockwise direction in the orientation of FIG. 6. Release of the stored energy may be restrained by a ratcheting pawl 90 pivotable about all axis 92 and spring biased in a clockwise direction (as illustrated) by a coil spring 94 to engage ratcheting gearwheel 86. A lever 96 may be provided for disengaging ratcheting pawl 90 from ratcheting gearwheel 86 upon pivotal movement thereof in a clockwise direction for engagement with pawl lever 98 extending from ratcheting pawl 90. A second motor 100 may be provided for rotating lever 96 for engagement with pawl lever 98, and a stop 102 may be provided for preventing over-actuation of lever 96 and pawl lever 98.

In operation, in order to actuate release mechanism 80 from its charged to its discharged configurations, upon receiving a signal from source 28, electronic control unit 26 may actuate system 10 and thus actuate release mechanism 80 to operate motor 100 to drive lever 96 in a clockwise direction to disengage pawl 90 from ratcheting gearwheel 86. Upon disengagement of pawl 90, the coil spring (not shown, but disposed behind ratcheting gearwheel 86 in a similar manner as soil spring 50), which has been wound, may cause ratcheting gearwheel 86 to rotate in a clockwise discharge direction D in the orientation of FIG. 6. Ratcheting gearwheel 86, which in the embodiment illustrated, is in the form of a pinion, may thus drive rack 104 upwards in the perspective of FIG. 6 to thus place movable linkage 14 in tension for release of latch 12. In the embodiment of FIG. 6, during the clockwise discharging rotation of ratcheting gearwheel 86, tensioning gear 84 may simply rotate as needed. This may be accomplished by using, for example, an electromagnetic motor 82 which may allow free rotation of tensioning gear 84 during the discharging process. After release of latch 12, release mechanism 80 may again be placed in a charged configuration in which motor 82 may be operated to drive tensioning gear 84 to rotate ratcheting gearwheel 86 in a counter-clockwise charge direction C to therewith wind and charge the coil spring. As discussed above, once fully wound, ratcheting gearwheel 86 may be held in place by pawl 90. The afore-described charging/discharging processes may be repeated as needed upon receiving further signals from source 28.

Figure 7:
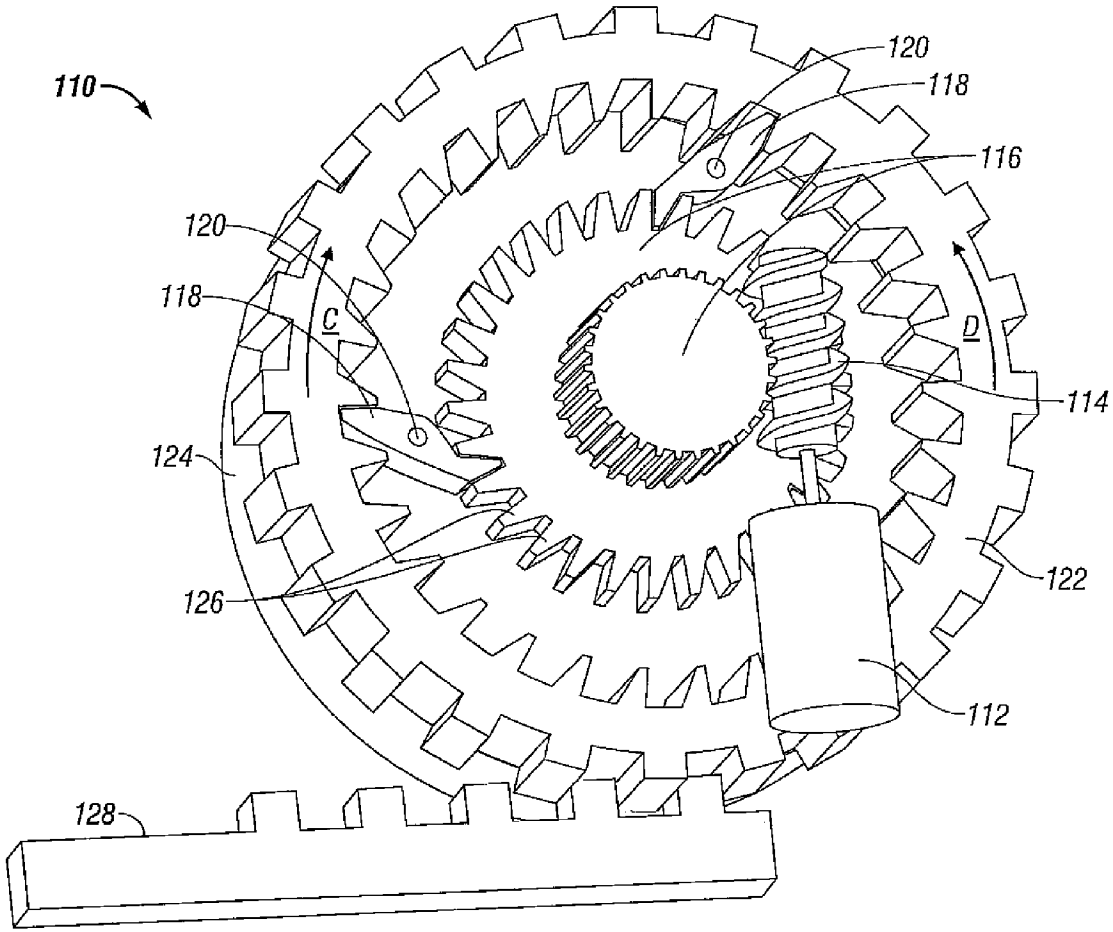
FIG. 7 is an illustrative isometric view of another embodiment of the door latch release system of FIG. 1, illustrating the system in a rest configuration.
Figure 8:
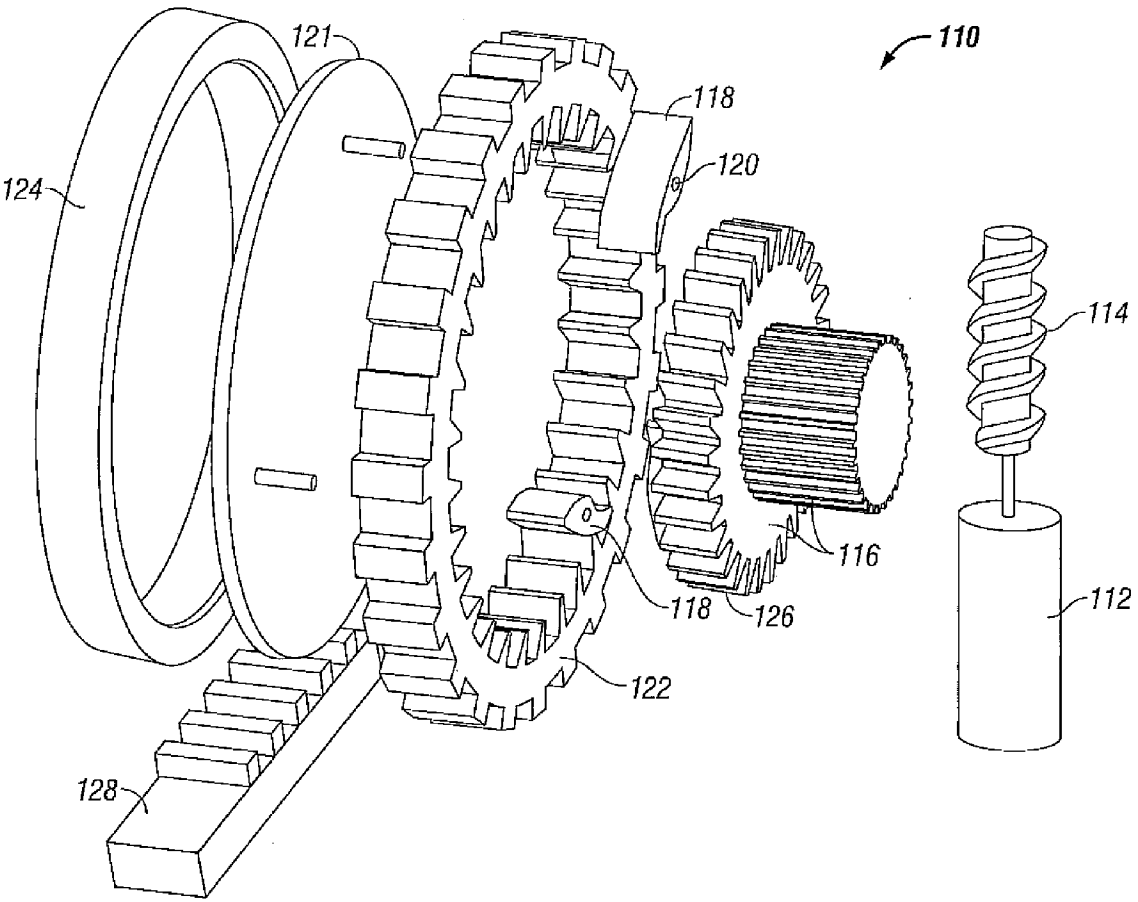
FIG. 8 is an exploded view of the door latch release system embodiment of FIG. 7.

Referring to FIGS. 7 and 8, a further embodiment of release mechanism 18, now designated 110 is illustrated. Release mechanism 110 may include a motor 112 having an output shaft affixed to or formed with a worm 114 engageable with inner ratcheting gearwheels 116. Inner ratcheting gearwheels 116 may be engageable by multiple ratcheting pawls 118 (three illustrated) pivotable about axes 120 and connected to a freewheeling plate 121. Pawls 118 may be engageable at their opposite ends with the internal gear teeth of an outer ratcheting gearwheel 122. Outer ratcheting gearwheel 122 may be affixed to or formed with a coil spring 124 (similar to coil spring 50 of the FIGS. 4 and 5 embodiment, to windably store energy in the coil spring as outer ratcheting gearwheel 122 is rotated by motor 112. Release of the stored energy may be restrained by ratcheting pawls 118 when in an engaged configuration as illustrated in FIG. 7. Ratcheting pawls 118 may be disengageable from the internal gear teeth of outer ratcheting gearwheel 122 by reversing the direction of rotation of motor 112. The ratcheting teeth 126 of the larger diameter inner ratcheting gearwheel 116 may now rotate in a counter-clockwise direction as illustrated to displace pawls 118 from an engaged configuration into a disengaged configuration. Disengaging pawls 118 from outer ratcheting gearwheel 116 causes coil spring 124 to rotate outer ratcheting gearwheel 122 in a counter-clockwise direction in the perspective of FIG. 7. Outer ratcheting gearwheel 122 may be formed with pinion teeth on its outer circumference so as to drive a rack 128 to the right in this perspective to move movable linkage 14.

In operation, in order to actuate release mechanism 110 from its charged to its discharged configurations, upon receiving a signal from source 28, electronic control unit 26 may actuate system 10 and thus actuate release mechanism 110 to operate motor 112 to rotate ratcheting gearwheels 116 in a counter-clockwise direction to disengage pawls 118 from ratcheting gearwheel 122. It should be noted that while pawls 118 may stall against the larger diameter ratcheting gearwheel 116 in the embodiment illustrated, if needed, gearwheels 116 may be continuously rotated in a counter-clockwise direction to prevent pawls 118 from re-engaging with ratcheting gearwheel 122. Upon disengagement of pawls 118, coil spring 124, which has been wound, may cause ratcheting gearwheel 122 to rotate in a counter-clockwise direction (i.e. direction D) in the orientation of FIG. 7. Ratcheting gearwheel 122, which in the embodiment illustrated, is in the form of a pinion, may thus drive rack 128 to the right in the perspective of FIG. 7 to thus place movable linkage 14 in tension for release of latch 12. After release of latch 12, release mechanism 110 may again be placed in a charged configuration in which motor 112 may be operated to drive gears 116 to rotate ratcheting gearwheel 122 in a clockwise direction (i.e. direction C in the FIG. 7 embodiment) to therewith wind and charge the coil spring. As discussed above, once fully wound, ratcheting gearwheel 122 may be held in place by pawls 118. The afore-described charging/discharging processes may be repeated as needed upon receiving further signals from source 28.

It should be noted that while the door latch release systems described above have been described for unlatching a door latch 12, the latch release systems may likewise be used with vehicles for which the pulling of a release cable (such as cable 20; see FIG. 1) only unlocks the door without releasing the latch (i.e. for rear doors). Those skilled in the art would further readily appreciate in view of this disclosure that the principles of the present invention may be readily applied in either case which allows a door to be only unlocked or a latch to be released (as discussed above) as long as the unlatching or unlocking (or yet another function) requires the pulling of a release cable. It should also be noted that those skilled in the art would appreciate that the components of these embodiments may be variously combined with one another to form alternate embodiments. Moreover, for the various gears and ratcheting gearwheels illustrated in FIGS. 4-7, as well as the complementary racks thereof, instead of the conventional gear teeth shown, the gears and gearwheels may include curved ratcheting teeth so that the ratcheting pawls effectively ride against the teeth during the charging event.

To summarize, the door latch release systems described above are beneficial in that they can be used with existing latching systems with over-ride, as well as with latching (or unlocking) systems which utilize a release cable. The noted systems prevent costly development of new passive entry side door latches, and work independently of the electronic control unit to thus allow for independent design, installation, operation and maintenance of the systems. The systems may also be implemented with minimal change of an internal door structure, thus avoiding the implementation of expensive and complex passive door latch release systems. The systems also operate quickly due to the use of stored spring energy, as opposed to the requirement of large and expensive motors for tensioning the latch release cable under 50 ms, for example, which is a required release parameter for such passive entry door latch systems.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A vehicle passive entry side door latch release system engageable with a release cable connected to a door latch, said door latch release system comprising:

a moveable linkage assembly engageable with the release cable;

a motor including an output shaft selectably engageable with a tensioning gear selectably engageable to drive a ratcheting gearwheel rotatably affixed to a coil spring, said ratcheting gearwheel including external teeth engageable with a rack affixed to or formed with said linkage assembly to move the release cable to unlatch the door latch; and at least one pivotable ratcheting pawl selectably engageable with said ratcheting gearwheel to one of allow and prevent rotation of said ratcheting gearwheel, wherein operation of said motor in a first motor rotary direction selectably drives said tensioning gear to drive said ratcheting gearwheel in a first gear rotary direction to energize said coil spring, and operation of said motor in a second opposite motor rotary direction selectably disengages said ratcheting pawl to allow stored energy in said coil spring to drive said ratcheting gearwheel in a second opposite gear rotary direction to thereby drive said rack to move the release cable to unlatch the door latch.

2. A door latch release system according to claim 1, wherein said linkage assembly includes at least one aperture for insertion of at least one cable, and further includes a lever contiguously engaged with a leaf spring and attachable at one end thereof to a first cable attachable to said rack, attachable at a second opposite end thereof to a second cable attachable to an inside door handle, and attachable at an intermediate location thereof to the release cable.

3. A door latch release system according to claim 1, wherein said linkage assembly is spring biased towards the release cable to maintain the door latch in a latched configuration.

4. A door latch release system according to claim 1, wherein said linkage assembly includes a lever attachable at a first location thereof to a first cable attachable to said rack, attachable at a second location thereof to a second cable attachable to an inside door handle, and attachable at a third location thereof to the release cable.

5. A door latch release system according to claim 1, wherein said motor output shaft is selectably engageable with said tensioning gear or with said ratcheting pawl respectively by a first clutch plate engageable with a second clutch plate to drive said tensioning gear and by said first clutch plate engageable with a third clutch plate to disengage said ratcheting pawl from said ratcheting gearwheel.

6. A door latch release system according to claim 1, further comprising an electronic control unit for controlling said motor.

7. A vehicle passive entry side door latch release system engageable with a release cable connected to a door latch, said door latch release system comprising:

a moveable linkage assembly engageable with the release cable;

a motor including an output shaft engaged with a tensioning gear for driving a ratcheting gearwheel rotatably affixed to a coil spring, said ratcheting gearwheel including external teeth engageable with a rack affixed to or formed with said linkage assembly to move the release cable to unlatch the door latch; and at least one pivotable ratcheting pawl selectably engageable with said ratcheting gearwheel to one of allow and prevent rotation of said ratcheting gearwheel, wherein operation of said motor drives said tensioning gear to drive said ratcheting gearwheel in a first gear rotary direction to energize said coil spring, and disengagement of said ratcheting pawl from said ratcheting gearwheel allows stored energy in said coil spring to drive said ratcheting gearwheel in a second opposite gear rotary direction to thereby drive said rack to move the release cable to unlatch the door latch.

8. A door latch release system according to claim 7, wherein said linkage assembly includes at least one aperture for insertion of at least one cable, and further includes a lever contiguously engaged with a leaf spring and attachable at one end thereof to a first cable attachable to said rack, attachable at a second opposite end thereof to a second cable attachable to an inside door handle, and attachable at an intermediate location thereof to the release cable.

9. A door latch release system according to claim 7, wherein said linkage assembly is spring biased towards the release cable to maintain the door latch in a latched configuration.

10. A door latch release system according to claim 7, wherein said linkage assembly includes a lever attachable at a first location thereof to a first cable attachable to said rack, attachable at a second location thereof to a second cable attachable to an inside door handle, and attachable at a third location thereof to the release cable.

11. A door latch release system according to claim 7, wherein said motor output shaft is engageable with said tensioning gear or with said ratcheting pawl respectively by a first clutch plate engageable with a second clutch plate to drive said tensioning gear and by said first clutch plate engageable with a third clutch plate to disengage said ratcheting pawl from said ratcheting gearwheel.

12. A door latch release system according to claim 7, wherein said ratcheting pawl is disengageable from said ratcheting gearwheel by one of an actuator, a further motor and a solenoid.

13. A door latch release system according to claim 7, further comprising an electronic control unit for controlling said motor.

* * * * *

UNITED STATES PATENT AND TRADEMARK OFFICE

CERTIFICATE OF CORRECTION

PATENT NO. : 7,270,029 B1
APPLICATION NO. : 11/460279
DATED : September 18, 2007
INVENTOR(S) : Kosta Papanikolaou et al.

It is certified that error appears in the above-identified patent and that said Letters Patent is hereby corrected as shown below:

On the Title page of the Letters Patent, "(74) Attorney, Agent or Firm--Dykema Gossett PLLC" should appear as follows:

-- (74) Attorney, Agent or Firm -- Gigette Bejin, Esq.; Dykema Gossett PLLC --

Signed and Sealed this

Twenty-seventh Day of November, 2007

JON W. DUDAS
*Director of the United States Patent and Trademark Office*